United States Patent [19]

Marion

[11] 4,084,264

[45] Apr. 18, 1978

[54] BATTER TRAINING SAFETY JACKET

[76] Inventor: Sebastino T. Marion, 28029 Elmdale, St. Clair Shores, Mich. 48081

[21] Appl. No.: 675,578

[22] Filed: Apr. 9, 1976

[51] Int. Cl.[2] ..... A41D 13/00

[52] U.S. Cl. ..... 2/2

[58] Field of Search ..... 2/2, 16

[56] References Cited

U.S. PATENT DOCUMENTS

| | | | |
|---|---|---|---|
| 1,796,782 | 3/1931 | Gasperini | 2/16 X |
| 2,589,636 | 3/1952 | Smith | 2/16 |
| 2,990,549 | 7/1961 | Doughty | 2/2 |
| 3,076,197 | 2/1963 | Glahe | 2/2 |
| 3,500,472 | 3/1970 | Castellani | 2/2 |

*Primary Examiner*—Alfred R. Guest

*Attorney, Agent, or Firm*—David A. Maxon

[57] ABSTRACT

A safety jacket avoid to protect the batter, particularly a child, from injury to back portions of the body, particularly rib, spinal and kidney injuries.

4 Claims, 7 Drawing Figures

BATTER TRAINING SAFETY JACKET

This invention relates generally to a safety jacket for a baseball player. More particularly, this invention relates to a safety jacket for a batter, particularly for a child.

In the past, jackets for providing protection to a batter have been devised. An example of such a jacket is one that covers one side of the body only and the front and back portions are connected by means of straps that go around the opposite side of the body. Such jackets are inadequate because they fail to protect both sides of the back of the batter. This is important because batters often move in trying to duck a pitched ball directed at their body. In the process of ducking they often turn in one direction or another thus exposing both sides of the back of the batter. Thus, a batter wearing a previous jacket as just described, may sustain an injury in an unprotected area of his back.

Another example of a protective garment for batters that has been devised in the past relates to a chest protector which protects only the front upper chest of the batter. This type of device is inadequate because often a portion or all of the batter's back is exposed to a pitched ball, particularly if the batter remains in the batting stance, and even more frequently when the batter turns or partially turns in attempting to avoid a pitched ball. Still other batter safety garments have been devised which protect only the kidney area. Again these are inadequate because it leaves unprotected portions of the batter, particularly upper portions of the back and possibly spinal areas, thus exposing these unprotected areas to injury from a pitched ball.

Still other devices are designed only to protect the shoulder area or the lower back area and upper thigh area, and other limited portions of the areas most likely to be hit by a pitched ball. Difficulty with such devices is that they provide inadequate coverage of protection and thus leave open probable areas of the body to possible injury due to normal movements of a batter, both in the batting stance, and in the attempts of the batter to move or duck to avoid a ball pitched directly at them.

As a result of the inadequate protection of such prior art devices, quite a large number of very serious injuries to batters have been sustained. These injuries include but are not limited to injuries to ribs, spinal injuries, kidney injuries, and elbow injuries. These injuries are particularly serious when the players are young children such as those of little league age. There are literally thousands of cases of children of such age being injured during batting due to being hit by a pitched ball. Sometimes these injuries result in permanent disablement of the child.

The injuries are not limited to merely physical injuries. Because of the fear of being hit, young players are discouraged from taking an aggresive stance as a batter and the quality of their playing suffers.

Similarly, young pitchers, who are afraid of hurting opposing ball players, fail to pitch in an aggressive and athletic improving and effective manner.

Thus, the present invention is designed not only to remove if not eliminate a large number of potential bodily injuries to players, but in addition, by using the present invention, players, both pitchers and batters, achieve greater self confidence towards playing a better game of baseball, and consequently achieving the values that come about when athletic enterprises are pursued with vigor and confidence. These advantages in mental attitudes are particular to youngsters, particularly those of little league age.

Accordingly, it is an object of this invention to provide a batter training safety jacket that protects the entire back of the batter as well as the elbow of the batter on the arms of the batter that faces the pitcher, where such a safety jacket is comfortable to wear, particularly comfortable in going through the exercises during the batting phase of play, that is lightweight in construction, and is convenient and inexpensive to manufacture, use, and maintain.

It is another object of this invention to provide a batter safety training jacket that is reversible so that the same unit can be reversed and worn by both a right and left hand player.

It is still a further object of this invention to provide an improved batter training safety jacket that is readily adjustable to fit various sized batters who bat either righthanded or lefthanded.

These and other objects of this invention are achieved by the provision of the jacket that has a batting side and non-batting side. On the batting side, a lengthened sleeve is provided that has protective material around the elbow of the batter and has relatively thin fabric near the crease of the elbow to allow free movement of the batting side arm. The back of the jacket extends all the way across the back from the neck area all the way down to the buttock area. The front side of the jacket is relatively open on the non-batting side in front and relatively closed on the batting side. The material is of a quilted nature in the protected area and has non-quilted, relatively thin fabric in the non-protective areas. Fasteners in the form of belt hooks and loop combinations are provided to allow for an appropriate fit for different size batters. The jacket is designed to be reversible so that the same jacket can be reversed inside out so that it is applicable both to a right and left hand batter.

These and other objects of this invention can be understood from the following specifications and claims.

ON THE DRAWINGS

Figure 1:
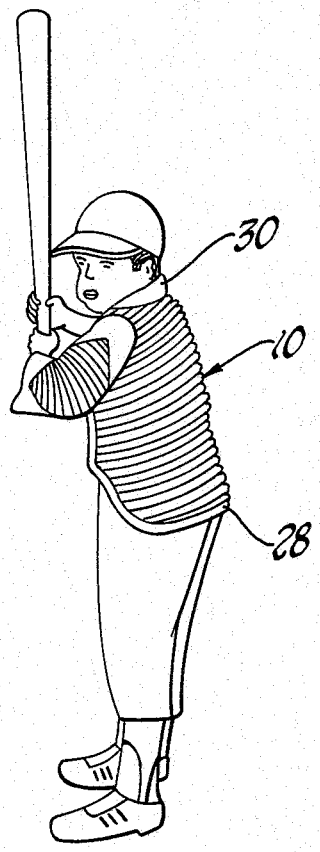
FIG. 1 is a three-dimensional view of a young batter wearing a preferred embodiment of this invention.
Figure 2:
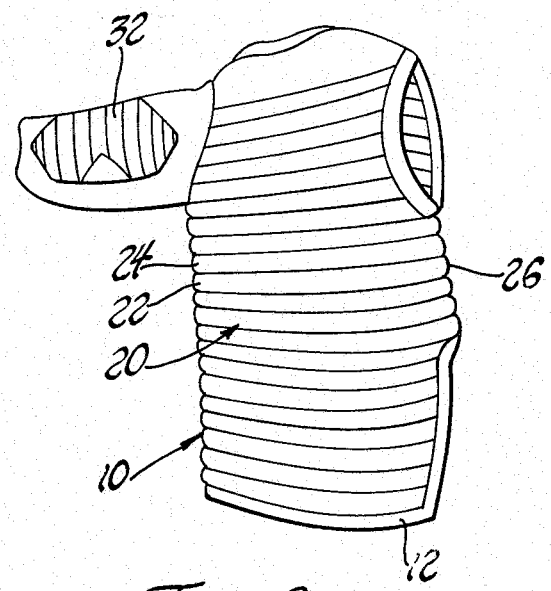
FIG. 2 is a perspective view from the back of a preferred embodiment of this invention.
Figure 3:
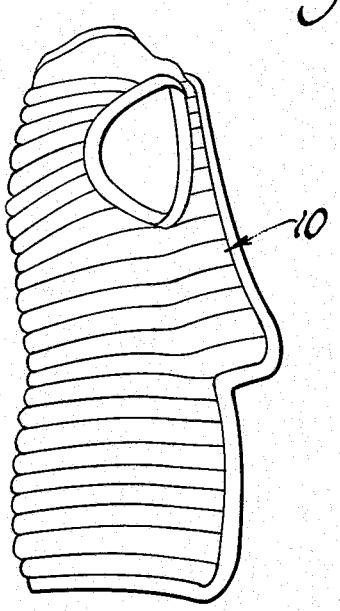
FIG. 3 is a side view from the right side of the apparatus shown in FIG. 2.

Before explaining the present invention in detail, it is to be understood that the invention is not limited in its application to the details in construction and arrangement of parts illustrated in the accompanying drawings since the invention is capable of other embodiments and of being practiced or carried out in various ways.

Also, it is to be understood that the phraseology and terminology employed herein are for the purpose of description and not of limitation.

AS SHOWN ON THE DRAWINGS

The preferred embodiment of the jacket 10 is shown in FIGS. 1 through 5. The jacket comprises a back panel portion 12 which is integrally connected with a left front portion 14 and a right front portion 16.

The left front portion 14 has a sleeve portion 18 integrally connected thereto. The right front portion 16 is sleeveless. The outer fabric of the jacket 10 is preferably of a nylon, canvas, of nylonlike material. Padding, shown generally at numeral 20, is in the form of horizontal ribs. Each of the ribs has an outer fabric covering of the aforementioned nylonlike material, and padding or wadding, preferably cotton, is provided in each of the horizontal ribs. The areas between two adjacent ribs, for example 22, 24, are connected by means of stitching 26 to enclose each of the ribs. Hemming extends from the bottom of the jacket, shown generally at numeral 28, and extends to the top of the jacket indicated at 30. The bottom of the jacket 28 is sufficiently low to cover at least the coccyx of the batter. The top of the jacket is sufficiently high at least to cover the back of the neck. Padding portions 32 are provided on the sleeve 18. However, the portions 34 proximate where the elbow would be bent is devoid of padding to allow freedom of motion at the juncture.

Upper and lower fastening members indicated generally at numerals 36 and 38, respectively, are provided in the front of the jacket to connect the right and lefthand portions 14, 16.

The upper fastening member 36 comprises a left portion 40 and a right portion 42. The left portion 40 comprises a fabric belt member 44 secured to the garment; a buckle member 46 attached to the end 48 of the fabric member through a loop in the fabric indicated generally at numeral 50. The buckle 46 comprises a forward loop portion 52, a rear loop portion 54, and a center lateral rib portion 56 positioned between the two. The rib portion 56 attaches into the fabric loop portion 50.

Near the buckle member 46, but somewhat further removed from the end 48 of the fabric, is placed a loop member 58. The loop member 58 has tab portions 60 that extend around the proximate fabric 62 so as to be slidably engaged thereon. The loop member 60 is operable to receive the end of the proximate fabric 62 so as to provide adjustments for tightening or loosening the belt of the fastener 40.

The fastener member 42 comprises a fabric portion 70 which is fixed to metal member 72 that has an eye portion 74. Fixing is done by means of a cord 76 that is stitched to the fabric of the belt 70. A swivel member 78 has a U-shaped metal pin member 80 rigidly fixed thereto. This U-shaped member 80 passes through the eye 74 of the metal member 72. A cylindrical portion 82 is attached to the metal member 78 in such a manner that it can rotate with respect to the metal member 78 but is limited from translating with respect to the metal member 78. A metal loop member 84 is rigidly attached to the swivel member 82. A hook member 86 is operable to be hinged against the member 82 by having a portion 88 thereof engage the loop member 84. The hook member 86 comprises a substantially thick and rigid hook portion 88 which is rigidly attached to a leaf spring member 90. The leaf spring member 90 is urged towards engagement of its end 92 with a corresponding end 94 of the fixed rigid hook portion 88.

Figure 7:
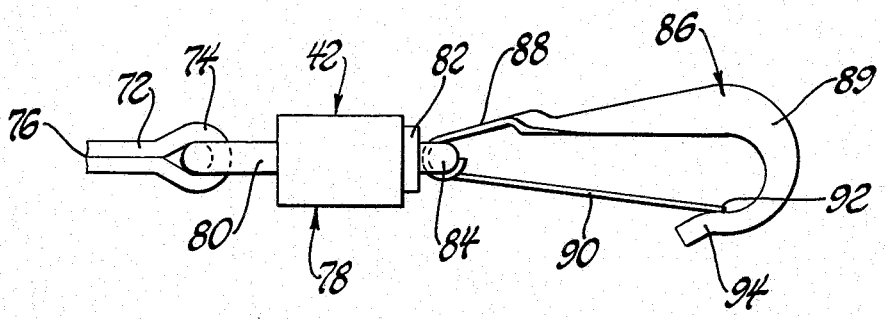
FIG. 7 is an enlarged view of another portion of the apparatus in FIG. 4.

In wearing the jacket 10, the player adjusts the loop portion 68 to a proper close-fitting position and engages the hook 88 with the buckle member 52 by passing the buckle member 52 between the end 92 of the leaf spring 90 and the corresponding end position 94 of the hook rigid portion 88. When this is accomplished, the leaf spring member 90 returns to its normal position illustrated in FIG. 7 to provide enclosure.

The structure and operation of fastening members 38 are precisely similar as those just described with respect to fastening members 36.

Figure 4:
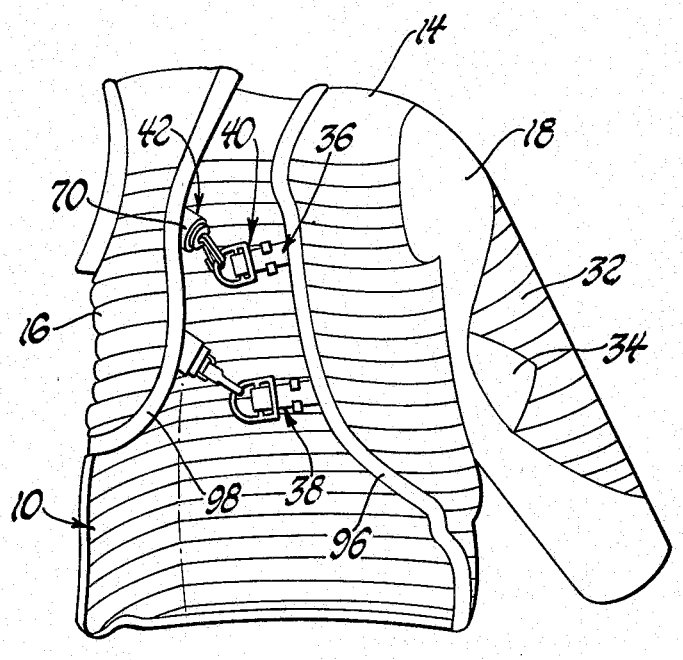
FIG. 4 is a front view of the apparatus shown in FIG. 2.

It will be apparent in FIG. 4 that portions of the left front portions 14 of the jacket 10, indicated generally at numeral 96, is cut away to provide freedom of movement of the forward portions of the thigh.

A similar portion 98 is shown with respect to the right side 16 of the front of the jacket 10.

Figure 5:
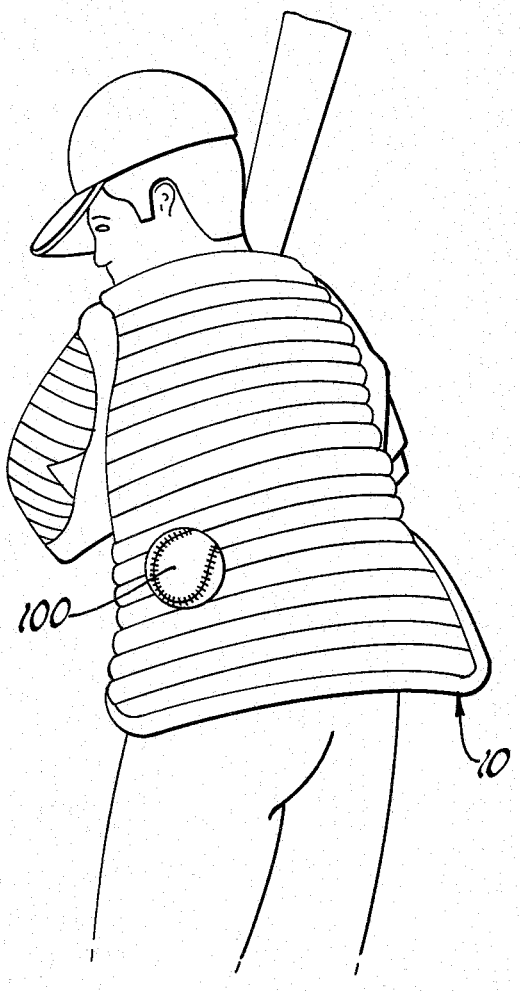
FIG. 5 is a view of the batter shown in FIG. 1 when the batter turns to duck a pitch aimed towards the middle of the batter.
Figure 6:
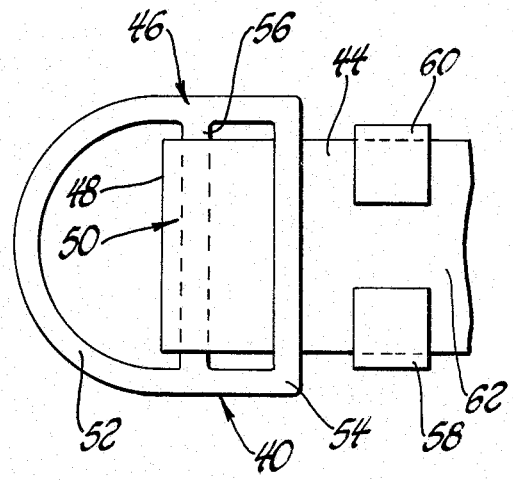
FIG. 6 is an enlarged detailed view of a portion of the apparatus shown in FIG. 4.

In FIG. 1, a batter is shown in the normal preparatory batting stance. In FIG. 5, the batter is shown after turning to duck away from a ball 100 which is pitched directly at the center of the batter's body. It will be observed that the jacket 10 provides protection to the kidneys in this particular instance.

It will be observed that the jacket 10 provides protection to the entire back area of the batter. More precisely, it provides protection to the entire spine extending from the coccyx all the way to the top of the neck. In addition, it provides protection to the kidneys.

In the front area, and on the sides, protection is provided to the ribs. Also, the arm of the batter facing a pitched ball will prevent injury to the elbow and adjacent arm and forearm areas.

It will be observed that the jacket 10 is completely reversible; that is, it can be completely turned inside out to provide protection for righthanded as well as lefthanded batters.

I claim:

1. In a jacket for a batter playing baseball, the improvements comprising:

a body portion;

a sleeve portion;

said sleeve portion being affixed to the left side of said body portion;

said sleeve portion having a first relatively thin fabric portion;

said sleeve portion having a relatively thick padding portion;

said sleeve padding portion located on said sleeve portion in such a manner that said padding covers the elbow and adjacent fore arm and adjacent upper arm regions;

said sleeve portion having a relatively thin fabric portion at the interior crux of the elbow;

said body portion having padding extending from the buttocks to the neck on the back thereof and extending from the thigh through collar bone in a vertical direction, and in a horizontal direction to the beginning of the rib cage on the front of said jacket said body portion comprising a back portion with integral left and right front vest portions;

said right portion of said jacket being sleeveless;

adjustable fastening means attached to the left and right front vest portions of said jacket;

said fastening portions having means for quickly engaging and disengaging the fasteners for fastening said jacket front portions in a safety position and for defastening said portions for quick removal of said jacket.

2. In the article of claim 1 padding portions on the interior surfaces of said sleeve and said body portions corresponding to the aforesaid exterior padding whereby said jacket may be turned inside out so that said jacket can accomodate both a left handed and right handed batter.

3. In the article of claim 1, said fastening members comprising fabric portions attached to the right and left portions respectively of the front of said body portions;

a buckle member attached to one of said fabric members;

a hook member attached by means of a swivel to the other of said fabric portions;

said hook member having a yieldably urging closure portion for engaging said buckle.

4. In the article of claim 3, a clip member engaging said fabric portion attached to said buckle member;

said clip member operable to gather a predetermined amount of said fabric portion to which it is clipped to shorten or lengthen said fabric member.

* * * * *